US007100844B2

(12) United States Patent
McGuire

(10) Patent No.: US 7,100,844 B2
(45) Date of Patent: Sep. 5, 2006

(54) HIGH IMPACT WATERJET NOZZLE

(75) Inventor: Dennis McGuire, Stuart, FL (US)

(73) Assignee: Ultrastrip Systems, Inc., Stuart, FL (US)

( * ) Notice: Subject to any disclaimer, the term of this patent is extended or adjusted under 35 U.S.C. 154(b) by 321 days.

(21) Appl. No.: 10/272,116

(22) Filed: Oct. 16, 2002

(65) Prior Publication Data

US 2004/0074979 A1 Apr. 22, 2004

(51) Int. Cl.
*B05B 7/06* (2006.01)

(52) U.S. Cl. ..... 239/424; 239/419.5; 239/429; 239/589; 175/67; 175/424

(58) Field of Classification Search ..... 239/8, 239/9, 423, 424, 419.5, 428.5, 429, 430, 239/431, 589; 134/31, 34, 38; 175/67, 424; 299/16, 17

See application file for complete search history.

(56) References Cited

U.S. PATENT DOCUMENTS

| | | | | | |
|---|---|---|---|---|---|
| 3,572,839 | A | * | 3/1971 | Okabe | 299/17 |
| 3,807,632 | A | * | 4/1974 | Johnson, Jr. | 239/424 |
| 4,342,425 | A | * | 8/1982 | Vickers | 239/424 |
| 4,497,664 | A | * | 2/1985 | Verry | 175/67 |
| 4,945,688 | A | | 8/1990 | Yie | |
| 5,154,347 | A | | 10/1992 | Vjay | |
| 5,217,163 | A | | 6/1993 | Henshaw | |
| 6,106,635 | A | * | 8/2000 | Hamada et al. | 134/34 |
| 6,116,858 | A | * | 9/2000 | Narabayashi | 134/31 |

* cited by examiner

*Primary Examiner*—Steven J. Ganey
(74) *Attorney, Agent, or Firm*—McHale & Slavin PA

(57) ABSTRACT

The present invention is directed to a nozzle capable of producing a high impact waterjet when supplied with a source of ulta-high pressure liquid. The nozzle is constructed and arranged to infuse fluid into a high velocity stream of liquid passing through the nozzle to create a bubble rich waterjet. When the waterjet strikes against a surface the bubbles implode, amplifying the impact of the water against the surface.

10 Claims, 4 Drawing Sheets

HIGH IMPACT WATERJET NOZZLE

FIELD OF THE INVENTION

This invention is directed to a waterjet nozzle having a means for infusing air into a high velocity stream of water to amplify the impact of the water against a work-piece.

BACKGROUND OF THE INVENTION

It is well known that a waterjet generated by directing pressurized water through a suitable orifice at a work-piece can remove a variety of organic and inorganic surface coatings such as paint or deposits. Modern cleaning systems often use waterjets to remove rust, scale or a variety of coatings. Much research has been conducted regarding the use of high and ultra-high pressure waterjets for cleaning applications. This has led to variations in waterjet technology directed at amplifying the impact of the water against the work-piece to increase material removal rates. A key component for successful waterjet cleaning/removal processes is the type of nozzle selected. Variations that have been investigated include: abrasive carried in a fluid, e.g. abrasive jet; interrupting the flow of exiting fluid, e.g. pulse waterjet; and forming bubbles within the fluid, e.g. cavitation waterjet.

The use of a pressurized fluid to carry abrasives to the work-piece is well known and commonly used. Various types of abrasives such as sand, pumice, walnut shells and glass beads have been added to pressurized fluids to create abrasive jets. Abrasive jets have the capability of eroding most surfaces and are most commonly used in situations where fluid jets without abrasive would not effectively clean the intended surface.

However, it is often undesirable to use an abrasive carried in a fluid. Many suitable abrasives are in the form of fine powders or dry granules that can cake up when wetted by a fluid, thus blocking the nozzle. Additionally, the erosive nature of abrasives cause nozzle wear and may contaminate or damage the surfaces being cleaned. The abrasive also creates additional hazardous waste requiring disposal.

Pulsed waterjets are also well known in the prior art. Pulsed waterjets are typically classified as either natural or forced pulse waterjets. There are several techniques for producing natural and forced pulse waterjets.

Natural pulsed waterjets, e.g. fanjets, are created when a continuous stream of high pressure water is directed though an orifice. Due to friction the emerging stream of water naturally breaks up into droplets at some distance from the nozzle. The droplets are considered to be natural pulsed waterjets. Natural pulsed waterjets are very common, and are suitable for simple cleaning operations.

Forced pulse waterjets are typically created by use of mechanical or electromechanical internally mounted devices used to interrupt the flow of water emerging from the nozzle. Devices such as a rotor modulating a continuous stream at a predetermined frequency, or an ultrasonic transformer or magnetostrictive transducer may be placed within the nozzle for causing pulses within the emerging waterjet. The pulses begin to disintegrate into droplets soon after the waterjet emerges from the nozzle.

Forced pulse waterjets are more effective than natural pulsed waterjets and can be used for removal or erosion of harder coatings. However, these devices require expensive and complex electrical components in order to actually produce an effective amount of pulses. Complex components often reduce reliability and increase the cost of manufacturing and maintaining these devices.

Cavitation waterjets are also well known in the art. The principle of cavitation involves directing water past a body. As the static pressure decreases below the vapor pressure of the water, bubbles of vapor form within the waterjet. Since the region of low pressure is generally small, the bubbles burst soon after they leave that region. When the nozzle is located at an optimum distance from the work-piece the bubbles implode upon themselves as they strike the surface. The imploding bubbles generate high forces and aid in cleaning or eroding surfaces. Cavitation jets are typically effective for cleaning and removing a wide variety of surfaces coatings.

In prior devices cavitation bubbles have been formed by directing high pressure water past a pin member located within the nozzle, by turning vanes to induce vortex cavitation, and by directing high pressure water past sharp corners within a nozzle causing pressure differentials. Unfortunately, for cavitating nozzles to actually produce a substantial amount of bubbles, the prior art requires nozzle members to be accurately machined and positioned. Precision machining and assembly often results in high production costs. Additionally, natural wear and lack of maintenance during use often results in nozzles being less efficient than desired.

Accordingly, a waterjet nozzle capable of producing a high impact waterjet when supplied with a source of ultra-high pressure liquid, e.g. water, would satisfy a long felt need in the art.

DESCRIPTION OF THE PRIOR ART

A number of patented devices exist for overcoming inherent problems associated with currently available high and ultra-high pressure nozzles.

U.S. Pat. No. 4,945,688 issued to Yie discloses a device for reducing nozzle wear in an abrasive jet apparatus. The nozzle entrains abrasive granules within a high pressure fluid jet before they exit the nozzle. The nozzle of this device comprises an orifice cone having a predetermined orifice passage in fluid communication with a high pressure fluid to provide a predetermined pattern of high pressure fluid streams. Abrasive granules are allowed to flow into the pattern of fluid streams. A large portion of the granules move to the center of the fluid streams to reduce inpingement and wear of the exit orifice as the fluid stream emerges from the nozzle.

This device minimizes some of the undesirable wear problems associated with abrasive carrying fluid jets. However, the problems of abrasive contaminating the surrounding machinery and creating additional hazardous waste cannot be eliminated when using this type of device.

U.S. Pat. No. 5,154,347 issued to Vijay discloses a cavitating or forced pulse waterjet. The device includes a nozzle body having a fluid flow channel formed axially therethrough with an inlet at an upstream end of the channel for receiving a pressurized fluid and an orifice at the downstream end of the body for discharging the pressurized fluid towards a surface to be eroded. Within the nozzle body a transformer is axially aligned with the flow channel to form in cooperation with the flow channel, an annulus between the two for the flow of the pressurized fluid. A vibrator ultrasonically oscillates the transformer to pulse the pressurized fluid prior to its discharge through the orifice.

While this device eliminates the need for mechanical rotors, it requires a precision center pin located within the nozzle to be oscillated by expensive and complex electrical components in order to produce an effective amount of pulses. Complex electrical components reduce reliability and increase the cost of maintaining these devices. There is also the additional danger of using electrical components in such close proximity to high pressure water.

U.S. Pat. No. 5,217,163 issued to Henshaw discloses a waterjet nozzle for producing cavitation in the passing pressurized fluid. The cavitating waterjet nozzle includes a pin received at a central position within the nozzle which lowers the static pressure causing cavitation bubbles to form within the water. The pin is self centering within the nozzle since it is free floating relative to a securing member which retains the pin in the nozzle.

This device eliminates the problem of manually centering the internal pin during manufacturing and operation. However, the internal pin is still required and must be precisely located in relationship to the mouth of the nozzle to achieve the optimum amount of cavitation within the waterjet.

None of the prior art patents address the concept of transforming a high velocity substantially laminar stream of water into a turbulent bubble rich waterjet by infusing the stream of water with air as achieved by the present invention.

SUMMARY OF THE INVENTION

The present invention is directed to a nozzle capable of producing a high impact waterjet when supplied with a source of ulta-high pressure liquid. The nozzle is constructed and arranged to infuse fluid into a high velocity stream of liquid passing through the nozzle to create a bubble rich waterjet. When the waterjet strikes against a surface the bubbles implode, amplifying the impact of the water against the surface.

By carefully minimizing external disturbances, it is possible to maintain laminar flow of a fluid such as water flowing at very high velocities. However, at high velocities a minor disturbance of the flow stream will cause the flow to suddenly change from laminar to turbulent. The current invention utilizes these principles to infuse air into a high velocity substantially laminar stream of water to create a bubble rich jet of turbulent water for cleaning or removing materials or coatings from a surface.

It is therefore an objective of the present invention to provide a device and method for infusing a high velocity substantially laminar stream of water with air to amplify the impact of a waterjet against a work-piece for removing organic and inorganic surface coatings, such as paint or deposits, from a work-piece.

Another objective of the present invention is to provide a device and method for removing organic and inorganic surface coatings from a work-piece, which is safe for use with respect to the environment and human operators.

Still another objective of the present invention is to provide a device and method for removing organic and inorganic surface coatings utilizing a high or ultra-high pressure water jet without the need for internal, moving, or electrical components.

Yet another object of the present invention is to provide a device and method for removing organic and inorganic surface coatings that may be utilized on existing equipment.

Still yet another object of the present invention is to provide a nozzle kit, which may be assembled for cooperation with new or existing equipment.

Other objects and advantages of this invention will become apparent from the following description taken in conjunction with the accompanying drawings wherein are set forth, by way of illustration and example, certain embodiments of the invention. The drawings constitute a part of this specification and include exemplary embodiments of the present invention and illustrate objects and features thereof.

DETAILED DESCRIPTION OF THE INVENTION

Figure 1:
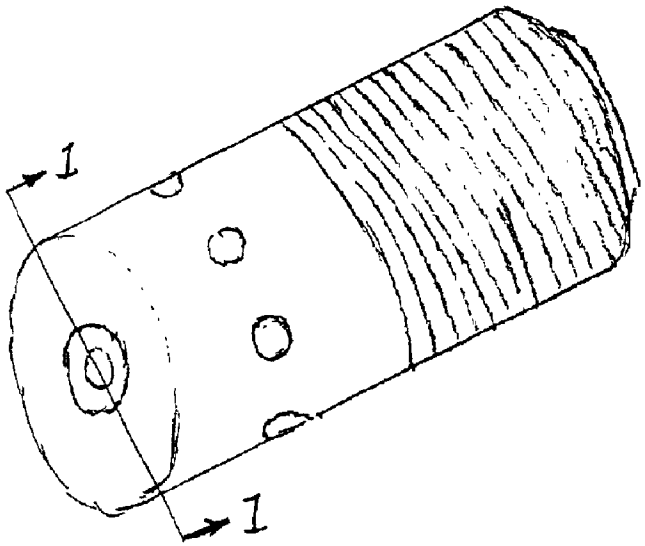
FIG. 1 is a perspective view of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
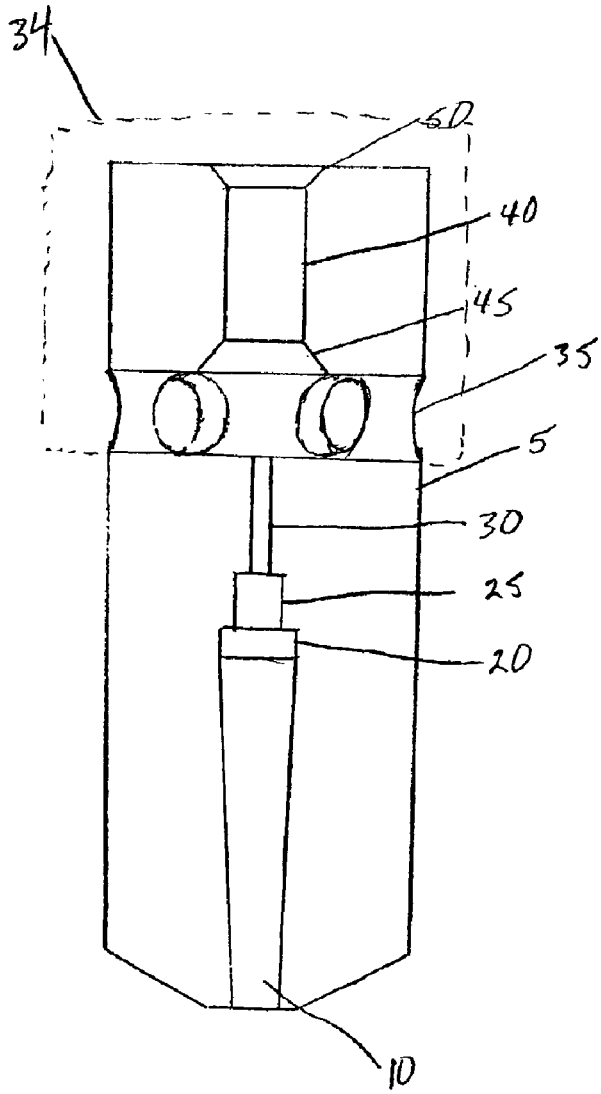
FIG. 2 is a cross sectional view of the present invention as shown in FIG. 1 along section line 1—1.

Now referring to the drawings, and particularly FIGS. 1 and 2 of the present invention, it can be seen that a ultra-high pressure waterjet nozzle 1 is shown. Waterjet nozzle 1 includes nozzle body 5 which may be made of steel, carbide, ceramic or other suitable wear resistant materials. The nozzle body 5 is constructed and arranged for connection to a source of ultra-high pressure fluid, e.g. water, typically having a pressure of at least 25,000 PSI. An orifice is centrally located within the nozzle body 5. The orifice is constructed of a series of fluid connected bores arranged for producing a high velocity substantially laminar stream of fluid. The first bore 10 is a conically increasing bore, having inlet of a first diameter and outlet of a larger diameter. The second bore 20 is substantially the same diameter as the outlet diameter of the first bore 10. The third bore 25, is smaller in diameter than the second bore 20. The fourth bore 30 is smaller in diameter than the third bore 25. In the preferred embodiment, the fourth bore has a diameter of about 0.010 to 0.016 inches. The portion of nozzle body 5 containing the fourth bore 30 may be an inserted disk constructed of a very hard material for increased wear resistance. Such materials as sapphire, ruby, diamond, ceramics, carbides, cermets, laminates of these materials or other suitable very hard materials may be used to construct the inserted disk. The velocity of the liquid stream emerging from fourth bore 30 in the preferred embodiment is generally but should not be limited to, between 1500 ft/sec and 3,000 ft/sec.

The high velocity substantially laminar liquid stream emerging from the fourth bore 30 is directed through an infuser 34. Within the infuser is a centrally located infusion aperture 40. The infusion aperture 40 has a chamfered entrance 45 and a chamfered exit 50. The infusion aperture 40 has a large enough bore so that the laminar fluid stream may pass through the infusion aperture 40 without substantial contact. As the liquid stream passes through the infusion aperture 40 fluid, e.g. air, is drawn in through the air orifice 35 causing disturbance within the liquid stream. The disturbance allows the fluid to infuse into the liquid stream transforming it into substantially turbulent bubble rich waterjet.

Figure 3:
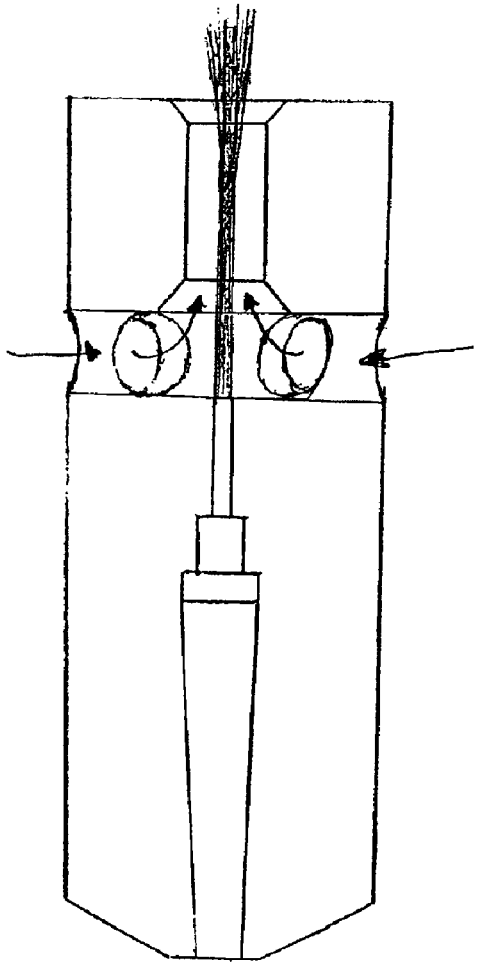
FIG. 3 is a cross sectional view of the present invention as shown in FIG. 1 along section line 1—1, showing the water flow through the nozzle and illustrating the effect of infusing air into the substantially laminar stream of high velocity water.

FIG. 3 illustrates the effect of the incoming fluid transforming the substantially laminar liquid stream into a substantially turbulent bubble rich waterjet as it flows from the orifice, through the infusion aperture 40 and exits to the work-piece.

Figure 4:
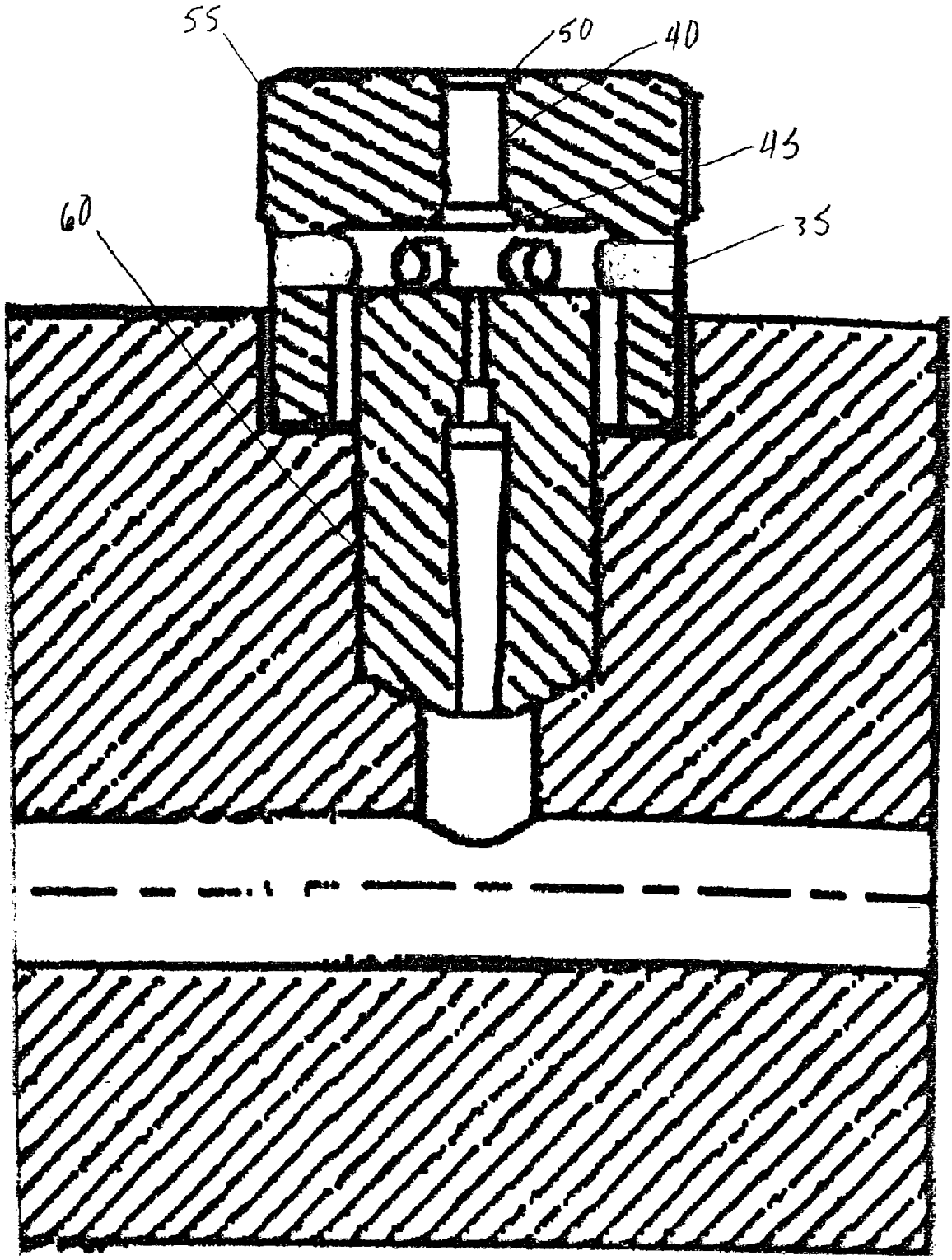
FIG. 4 is a cross sectional view showing an alternative embodiment of the present invention.

FIG. 4 illustrates an alternative embodiment of the present invention. In the alternative embodiment the infuser member 55 containing the infusion aperture 40 and the air orifices 35 is constructed and arranged for suitable attachment over a nozzle body 60. Many suitable attachment methods, well known in the art, may be used to locate and attach the separate members for adequate cooperation. It is understood and anticipated that the alternative embodiment is well suited for retrofitting or updating existing equipment utilizing ultra-high pressure nozzles.

Additionally, this assembly may be sold as an unassembled kit containing the forgoing elements.

All patents and publications mentioned in this specification are indicative of the levels of those skilled in the art to which the invention pertains. All patents and publications are herein incorporated by reference to the same extent as if each publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention, which are obvious to those skilled in the art, are intended to be within the scope of the following claims.

What is claimed is:

1. An ultra-high pressure waterjet nozzle assembly to infuse fluid into a high velocity stream of liquid to amplify the impact of the liquid against a work-piece for removing organic and inorganic surface coatings such as paint or deposits comprising:

a nozzle body constructed and arranged for communication with an ultra-high pressure liquid; and an orifice means disposed in said nozzle body so as to be in communication with said high pressure liquid for concentrating said high pressure fluid into a high velocity substantially laminar liquid stream; and an infuser means connected to said nozzle body for injecting fluid, said infuser means constructed and arranged to transform said substantially laminar liquid stream into a substantially turbulent bubble rich waterjet wherein said ultra-high pressure liquid has a pressure of at least about 25,000 pounds per square inch.

2. The device of claim 1 wherein said infuser means further comprises an infusion aperture, said liquid stream passing through said infusion aperture substantially without contact.

3. The device of claim 2 wherein said infuser means further comprises at least one fluid orifice disposed therethrough to provide fluid for infusion into said liquid stream passing through said infusion aperture.

4. The device of claim 1 wherein said turbulent bubble rich water jet is sufficient to remove organic and inorganic surface coatings such as paint or deposits.

5. An ultra-high pressure waterjet nozzle assembly to infuse fluid into a high velocity stream of liquid to amplify the impact of the liquid against a work-piece for removing organic and inorganic surface coatings such as paint or deposits comprising:

a nozzle body constructed and arranged for communication with an ultra-high pressure liquid; and an orifice means disposed in said nozzle body so as to be in communication with said high pressure liquid for concentrating said high pressure fluid into a high velocity substantially laminar liquid stream; and an infuser means connected to said nozzle body for injecting fluid, said infuser means constructed and arranged to transform said substantially laminar liquid stream into a substantially turbulent bubble rich waterjet wherein said liquid stream has a velocity between 1500 ft/sec and 3,000 ft/sec.

6. A kit for assembling a high pressure waterjet nozzle to infuse fluid into a high velocity stream of liquid to amplify the impact of the liquid against a work-piece for removing organic and inorganic surface coatings such as paint or deposits comprising:

a nozzle body constructed and arranged for communication with an ultra-high pressure liquid; and an orifice means disposed in said nozzle body so as to be in communication with said high pressure liquid for concentrating said high pressure liquid into a high velocity substantially laminar liquid stream; and an infuser means, said infuser means having attachment/locating means, said infuser means constructed and arranged for injecting fluid into said liquid stream to transform said substantially laminar liquid stream into a substantially turbulent bubble rich waterjet wherein said ultra-high pressure liquid has a pressure of at least about 25,000 pounds per square inch.

7. The device of claim 6 wherein said infuser means further comprises an infusion aperture, said liquid stream passing through said infusion aperture substantially without contact.

8. The device of claim 7 wherein said infuser means further comprises at least one air orifice disposed therethrough to provide fluid for infusion into said liquid stream passing through said infusion aperture.

9. The device of claim 6 wherein said liquid stream has a velocity between 1500 ft/sec and 3,000 ft/sec.

10. The device of claim 6 wherein said turbulent bubble rich water jet is sufficient to remove organic and inorganic surface coatings such as paint or deposits.

* * * * *